US006206093B1

(12) United States Patent
Lee et al.

(10) Patent No.: US 6,206,093 B1
(45) Date of Patent: Mar. 27, 2001

(54) SYSTEM FOR PUMPING VISCOUS FLUID FROM A WELL

(75) Inventors: Woon Yung Lee; Diego Narvaez, both of Bartlesville; Ketankumar K. Sheth; William B. Newberry, both of Tulsa, all of OK (US)

(73) Assignee: Camco International Inc., Houston, TX (US)

( * ) Notice: Subject to any disclaimer, the term of this patent is extended or adjusted under 35 U.S.C. 154(b) by 0 days.

(21) Appl. No.: 09/256,875

(22) Filed: Feb. 24, 1999

(51) Int. Cl.[7] ..... E21B 36/04; E21B 43/00

(52) U.S. Cl. ..... 166/60; 166/62; 166/64; 166/66.4

(58) Field of Search ..... 166/53, 57, 60, 166/62, 64, 66, 66.4, 68.5, 105; 310/87

(56) References Cited

U.S. PATENT DOCUMENTS

| | | | | |
|---|---|---|---|---|
| 1,309,721 | * | 7/1919 | Drinkern | 166/60 |
| 2,429,940 | | 10/1947 | McDaniel . | |
| 2,530,280 | * | 11/1950 | Ackley | 166/60 X |
| 2,556,435 | | 6/1951 | Moehrl et al. . | |
| 2,601,533 | | 6/1952 | Koch . | |
| 2,615,114 | | 10/1952 | Colby . | |
| 2,632,836 | | 3/1953 | Ackley . | |
| 2,703,621 | | 3/1955 | Ford . | |
| 2,738,409 | | 3/1956 | Bowman . | |
| 2,742,967 | | 4/1956 | Carpenter . | |
| 2,951,165 | | 8/1960 | Arutunoff . | |
| 2,954,826 | * | 10/1960 | Sievers | 166/60 |
| 2,980,184 | | 4/1961 | Reed | 166/57 |
| 3,045,099 | | 7/1962 | Bowman et al. . | |
| 3,114,417 | * | 12/1963 | McCarthy | 166/60 |
| 3,130,287 | | 4/1964 | Toulmin, Jr. . | |
| 3,187,814 | | 6/1965 | McCarthy | 166/60 |
| 3,286,771 | | 11/1966 | Sisson . | |
| 3,420,301 | * | 1/1969 | Riley et al. | 166/62 X |
| 4,538,682 | * | 9/1985 | McManus et al. | 166/60 X |
| 4,685,867 | | 8/1987 | Patun et al. | 417/367 |
| 4,988,389 | * | 1/1991 | Adamache et al. | 166/62 X |
| 5,620,048 | | 4/1997 | Beauquin | 166/62 |
| 6,006,837 | * | 12/1999 | Breit | 166/62 X |

* cited by examiner

*Primary Examiner*—George Suchfield
(74) *Attorney, Agent, or Firm*—Fletcher, Yoder & Van Someren

(57) ABSTRACT

A system allows the pumping of viscous fluids from a wellbore. The system includes a submergible pump and a pump intake through which a fluid may be drawn. A submergible electric motor powers the submergible pump, and a heater is connected in the pumping system to heat the wellbore fluid. Additionally, a combination of heaters may be employed to heat the desired production fluid both externally to the pumping system and internally to the pumping system.

23 Claims, 7 Drawing Sheets

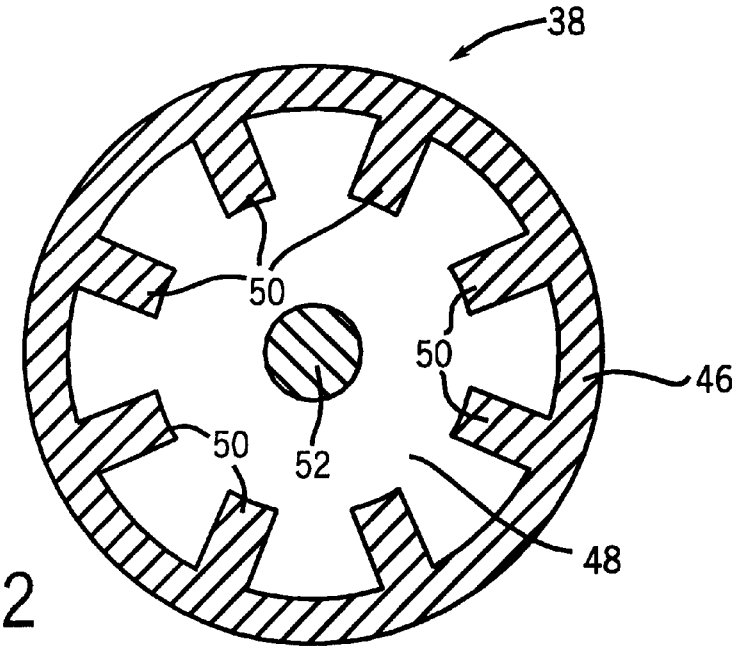
FIG. 2
FIG. 3
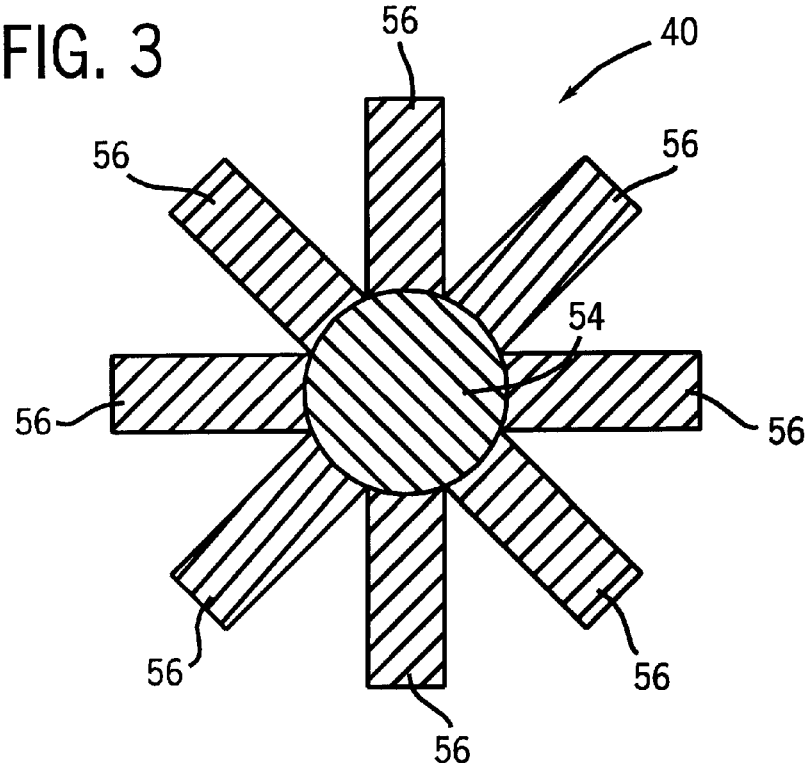

SYSTEM FOR PUMPING VISCOUS FLUID FROM A WELL

FIELD OF THE INVENTION

The present invention relates generally to pumping systems utilized in raising fluids from wells, and particularly to a submergible pumping system able to lower the viscosity of a desired fluid to facilitate pumping and movement of the fluid.

BACKGROUND OF THE INVENTION

In producing petroleum and other useful fluids from production wells, it is generally known to provide a submergible pumping system, such as an electric submergible pumping system, for raising the fluids collected in a well. Typically, production fluids enter a wellbore via perforations made in a well casing adjacent a production formation. Fluids contained in the formation collect in the wellbore and may be raised by the pumping system to a collection point above the earth's surface. The submergible pumping systems can also be used to move the fluid from one zone to another.

In an exemplary submergible pumping system, the system includes several components, such as a submergible electric motor that supplies energy to a submergible pump. The system may further include additional components, such as a motor protector for isolating the motor oil from well fluids. A connector also is used to connect the pumping system to a deployment system, such as cable, coil tubing or production tubing.

Power is supplied to the submergible electric motor via a power cable that runs along the deployment system. For example, the power cable may be banded to the outside of the coil tubing or production tubing and run into the well for electrical connection with the submergible motor.

In some wellbore environments, the desired fluids are highly viscous. The high viscosity creates difficulty in utilizing conventional submergible pumps, such as centrifugal pumps, for pumping the fluids to another zone or to the surface of the earth. It would be advantageous to have a system and method for reducing the viscosity of the fluid, such as petroleum, to facilitate movement, e.g. pumping of the fluid.

SUMMARY OF THE INVENTION

The present invention features a submergible pumping system for pumping fluids from a wellbore to the surface of the earth. The system includes a submergible pumping system having a submergible pump, a submergible motor and a heater. The submergible motor includes a drive shaft coupled to the submergible pump to power the submergible pump. The heater is mounted in the string of components between the submergible motor and the submergible pump. The heater includes an axial opening through which the drive shaft extends.

According to another aspect of the invention, a system is provided for pumping a viscous fluid from a wellbore. The system includes a submergible pump and a pump intake through which a fluid is drawn. The system further includes a submergible electric motor to power the submergible pump, a motor protector and a heater to lower the viscosity of the fluid. The submergible pump, the pump intake, the submergible electric motor, the motor protector and the heater are sequentially arranged for placement in a wellbore.

According to another aspect of the invention, a system is provided for pumping a viscous fluid disposed in a subterranean well. The system includes a heating chamber, a first pump and a second pump. The first pump may be a positive displacement pump and is disposed to pump a fluid into the heating chamber. The second pump includes a fluid intake disposed proximate the heating chamber. The heating chamber, first pump, and second pump are connected together in a pumping system that may be disposed in a wellbore.

BRIEF DESCRIPTION OF THE DRAWINGS

The invention will hereafter be described with reference to the accompanying drawings, wherein like reference numerals denote like elements, and:

FIG. 2 is a cross-sectional view taken generally along line 2—2 of FIG. 1;

FIG. 3 is a cross-sectional view taken generally along line 3—3 of FIG. 1;

DETAILED DESCRIPTION OF THE PREFERRED EMBODIMENTS

Figure 1:
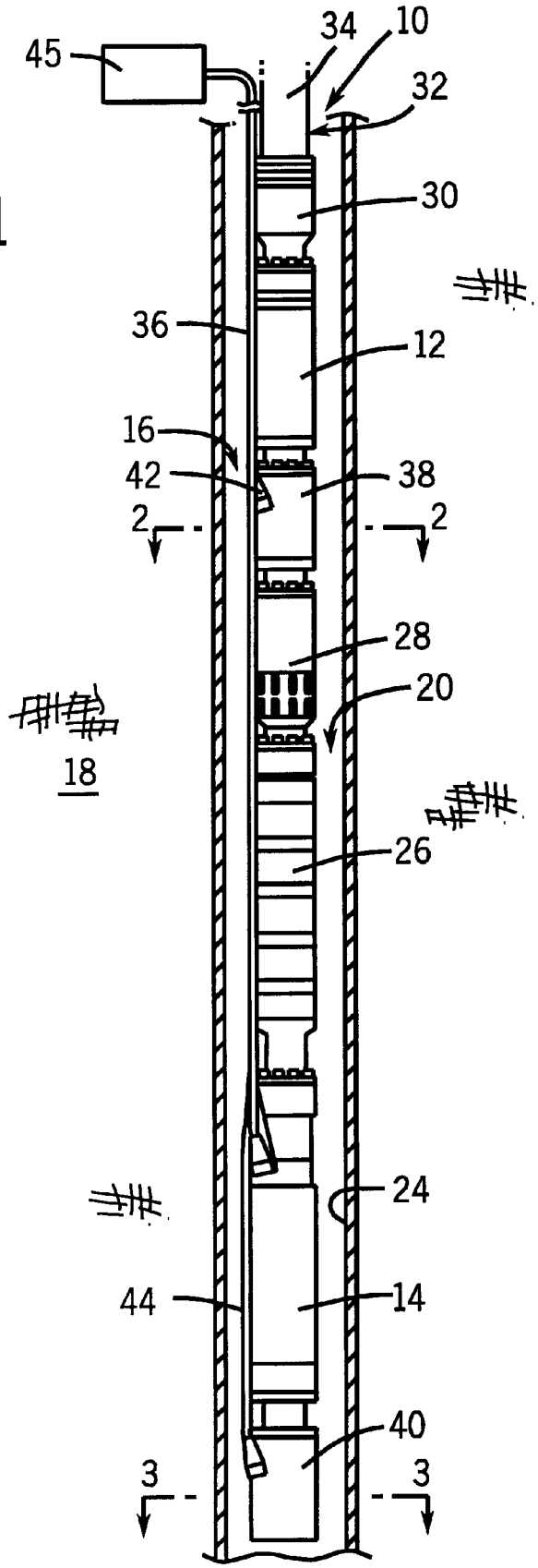
FIG. 1 is a front elevational view of a submergible pumping system positioned in a wellbore, according to a preferred embodiment of the present invention.

Referring generally to FIG. 1, a submergible pumping system 10, such as an electric submergible pumping system, is illustrated according to a preferred embodiment of the present invention. Submergible pumping system 10 may comprise a variety of components depending on the particular application or environment in which it is used. However, system 10 typically includes at least a submergible pump 12 and a submergible motor 14.

Submergible pumping system 10 is designed for deployment in a well 16 within a geological formation 18 containing desirable production fluids, such as petroleum. In a typical application, a wellbore 20 is drilled and lined with a wellbore casing 24. System 10 is deployed within wellbore 20 to a desired location for pumping of wellbore fluids. In accordance with the present invention, submergible pumping system 10 is designed to facilitate the pumping of viscous fluids that collect within wellbore 20 and that would otherwise be difficult to pump with a conventional submergible pumping system.

In the example illustrated, submergible pumping system 10 includes a variety of additional components. A motor protector 26 is connected to submergible motor 14 and serves to isolate the well fluid from motor oil contained within motor 14. The system 10 further includes a pump intake 28 through which wellbore fluids are drawn into submergible pump 12.

Submergible pumping system 10 also includes a connector or discharge head 30 by which the submergible pumping system is connected to a deployment system 32. Deployment system 32 may comprise a cable, coil tubing, or production tubing. In the illustrated embodiment, deployment system 32 comprises production tubing 34 through which the wellbore fluids are pumped to another zone or to the surface of the earth. A power cable 36 is disposed along deployment system 32 and routed to submergible motor 14 to provide power thereto.

In the preferred embodiment, submergible pumping system 10 includes a fluid heater 38 disposed between submergible motor 14 and submergible pump 12. Preferably, fluid heater 38 is connected between submergible pump 12 and pump intake 28, as illustrated in FIG. 1. System 10 preferably also includes a second fluid heater 40 connected in the string of submergible pumping system components at a position below pump intake 28 when system 10 is positioned in wellbore 20. In the illustrated embodiment, second fluid heater 40 is connected to submergible motor 14 on an opposite side from fluid heater 38.

Fluid heater 38 and second fluid heater 40 may be heated by virtue of a variety of power sources. However, heaters 38 and 40 preferably are electric heaters having a resistive core that rises in temperature when connected to an electrical power supply. As illustrated in FIG. 1, electric power cables 42 and 44 may be connected to heaters 38 and 40, respectively. Electric power cables 42 and 44 may be connected to main power cable 36 or extended independently along deployment system 32 to an appropriate power supply and control circuit 45, typically at the surface of the earth. Alternatively, power cables 42 and 44 may be connected internally to the motor 14.

In the preferred embodiment, fluid heater 38 includes a resistive core 46 through which an axial opening 48 extends (see FIG. 2). A plurality of protrusions 50 extend inwardly from resistive core 46 into axial opening 48. The temperature of resistive core 46 and protrusions 50 increases when powered by electric current supplied via electric power cable 42. Additionally, a drive shaft 52 extends through axial opening 48, as best illustrated in FIG. 2. If necessary, drive shaft support bearings (not shown) can be utilized to support drive shaft 52 at fluid heater 38. Furthermore, drive shaft 52 extends from submergible motor 14 to submergible pump 12 and powers pump 12, as is well known to those of ordinary skill in the art.

As submergible motor 14 rotates drive shaft 52 and powers submergible pump 12, fluid, such as petroleum, is drawn into pump intake 28 from wellbore 20. The vacuum or low pressure created by submergible pump 12 continues to draw the fluid from pump intake 28 into axial opening 48 of fluid heater 38. As the fluid moves upwardly through axial opening 48, resistive core 46 and protrusions 50 cooperate to raise the temperature of the fluid. The heated fluid has a lower viscosity that facilitates pumping of the fluid by submergible pump 12. The heated fluid may be pumped through production tubing 34 to another zone or to the surface of the earth.

As illustrated in FIG. 3, second fluid heater 40 is designed to heat the wellbore fluid while it is in wellbore 20. Second fluid heater 40 may have a variety of designs, but a preferred design includes a central resistive core or heating element 54 from which a plurality of protrusions 56 extend radially outwardly. When electricity is applied to second fluid heater 40 via power cable 44, the resistive heating core 54 and protrusions 56 rise in temperature, heating the surrounding fluid within wellbore 20.

Thus, second fluid heater 40 lowers the viscosity of the wellbore fluid before it is drawn into pump intake 28. Then, as the fluid is drawn through intake 28 and axial opening 48, fluid heater 38 further heats the fluid and further lowers its viscosity prior to being pumped by submergible pump 12. The combination of fluid heater 40 and fluid heater 38 substantially lowers the viscosity of a desired production fluid which aids in the efficient pumping of the otherwise viscous fluid by submergible pump 12.

Figure 4:
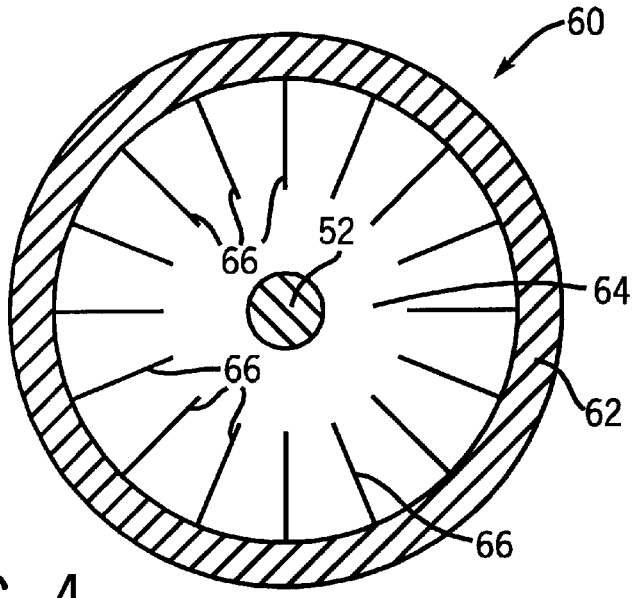
FIG. 4 is a cross-sectional view similar to that of FIG. 2 but showing an alternate embodiment.
Figure 5:
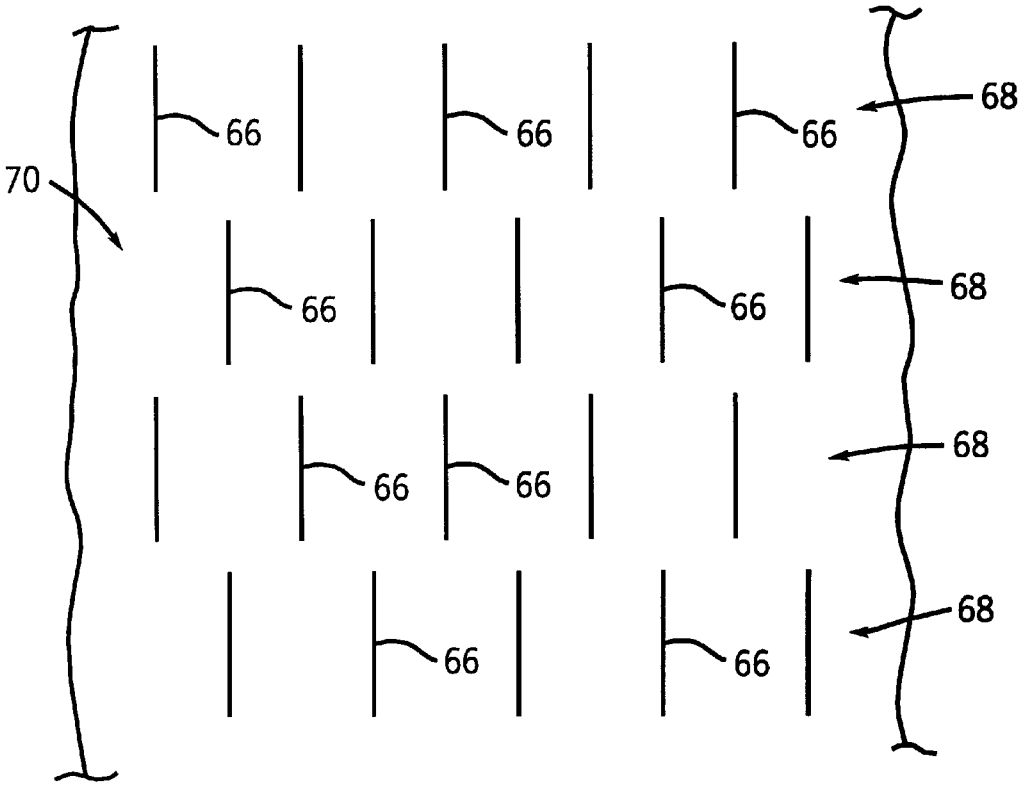
FIG. 5 is schematic representation of the mixing fin arrangement of the heater illustrated in FIG. 4.

Referring generally to FIGS. 4 and 5, an alternate embodiment of fluid heater 38 is illustrated. In this embodiment, a fluid heater 60 includes a resistive core or heating element 62 having an axial opening 64 therethrough. Drive shaft 52 extends through axial opening 64, as described with respect to heater 38.

In this embodiment, the inwardly extending protrusions comprise a plurality of fins 66. Fins 66 extend radially inwardly from resistive heating core 62 and cooperate with core 62 to heat the production fluid as it flows through axial opening 64.

Additionally, fins 66 are arranged in a plurality of rows 68, as illustrated best in the schematic diagram of FIG. 5. Rows 68 are disposed above one another along an axial direction moving from the axial bottom of fluid heater 60 to the axial top thereof. Furthermore, the fins 66 of adjacent rows 68 are staggered with respect to one another. The staggered fins create a mixing region 70 along fluid heater 60 that serves to mix the production fluid as it moves upwardly through axial opening 64. The mixing facilitates uniform heating of the production fluid to create a relatively consistent, lowered viscosity. Although staggering is a preferred arrangement, fins 66 can be arranged in line to provide heating.

Figure 6:
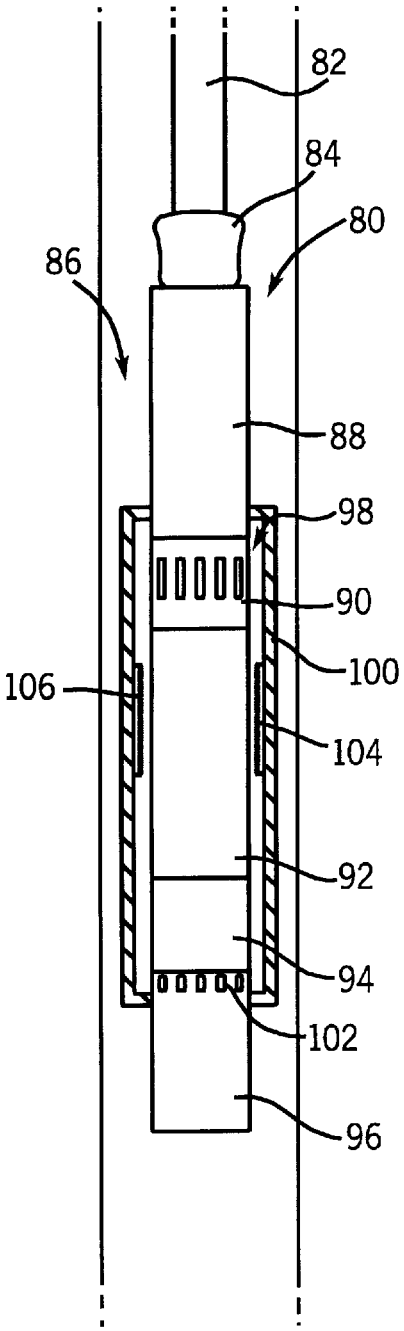
FIG. 6 is a front elevational view of a pumping system positioned in a wellbore, according to an alternate embodiment of the present invention.
Figure 7:
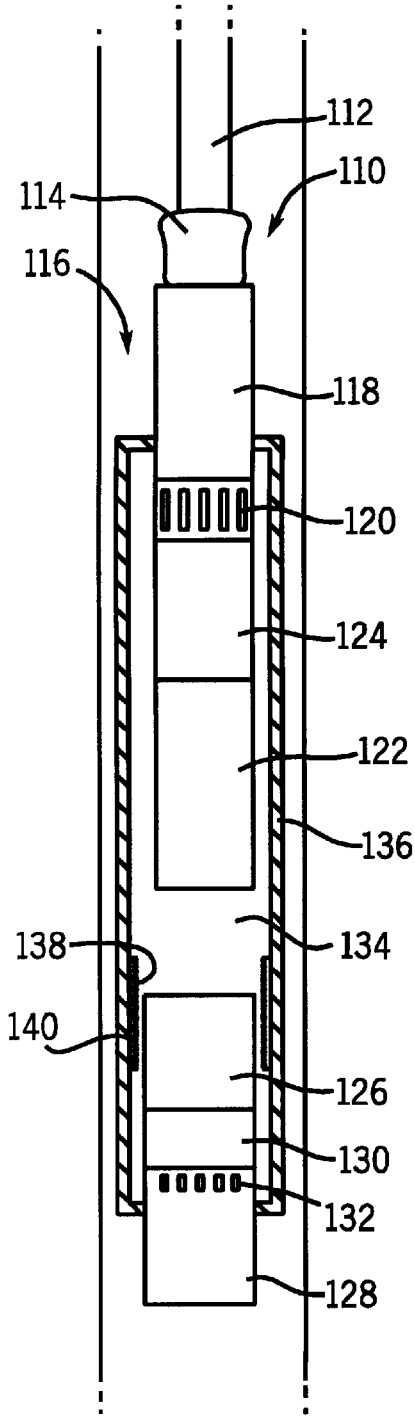
FIG. 7 is a front elevational view of a pumping system positioned in a wellbore, according to another alternate embodiment of the present invention.

Referring generally to FIGS. 6 and 7, alternate embodiments of pumping systems for pumping viscous fluids from wellbores are illustrated. In the embodiment illustrated in FIG. 6, a pumping system 80 is connected to a deployment system 82 by a connector or discharge head 84. Pumping system 80 is disposed within a wellbore 86 by deployment system 82.

In the embodiment of FIG. 6, pumping system 80 comprises a pump 88, such as a centrifugal electric submergible pump or progressive cavity pump. Pump 88 is connected to a pump intake 90. Pumping system 80 also includes a submergible motor 92, a gear box 94 and a viscous fluid pump 96, such as a positive displacement pump, for moving viscous fluids. It should be noted that it may be necessary to incorporate one or more motor protectors adjacent the top and/or bottom of submergible motor 92, as would be understood by one of ordinary skill in the art.

In the specific embodiment illustrated, submergible motor 92 is connected to viscous fluid pump 96 through gear box 94. Submergible motor 92 also may be connected to pump 88 via a drive shaft. Pump 88 is powered by submergible motor 92 to move production fluid through deployment system 82, e.g. production tubing.

Pumping system 80 further includes a heating chamber 98 formed by an outer housing 100, shown in cross-section to facilitate explanation. Typically, outer housing 100 is a generally tubular housing that is connected to viscous fluid pump 96 below a fluid outlet 102 of viscous fluid pump 96. The outer housing 100 extends upwardly from pump 98 and past pump intake 90, until it is connected to pump 88 by, for instance, a weldment or bolted flange (not shown). Thus, heating chamber 98 is formed between submergible motor 92 and outer housing 100.

As viscous fluid pump 96 is powered at an appropriate speed via submergible motor 92 and gear box 94, the relatively viscous fluid disposed within wellbore 86 is discharged through fluid outlet 102 into heating chamber 98. As viscous fluid pump 96 continues to pump fluid into heating chamber 98, the viscous fluid rises past submergible motor 92 and absorbs heat generated by the motor. This heat lowers the viscosity of the production fluid and allows it to be more readily drawn into pump intake 90 and pumped by pump 88 to another zone or to the surface of the earth. Furthermore, an auxiliary heater 104 may be disposed proximate heating chamber 98 by mounting a resistive element 106 to outer housing 100. Resistive element 106 is supplied with electrical power by an appropriate power cable as described above.

In the alternate embodiment illustrated in FIG. 7, a pumping system 110 is connected to a deployment system 112, such as production tubing, by an appropriate connector or discharge head 114. Pumping system 110 is deployed within a wellbore 116.

In this embodiment, pumping system 110 includes a submergible pump 118 connected to a pump intake 120. A submergible electric motor 122 is coupled to submergible pump 118 to provide power thereto. A motor protector or seal 124 may be disposed between pump intake 120 and submergible motor 122, as illustrated.

Pumping system 110 further includes a second submergible motor 126 connected to a viscous fluid pump 128, such as a positive displacement pump, by an appropriate gear box 130. Positive displacement pump 128 is designed to draw viscous fluid from wellbore 116 and to discharge the viscous fluid through a fluid outlet 132.

A heating chamber 134 is formed around submergible motors 122 and 126. Heating chamber 134 is defined by an outer housing 136 that extends axially from a point beneath fluid outlet 132 to a point above pump intake 120, generally as described with respect to the embodiment illustrated in FIG. 6.

In operation, positive displacement pump 128 is powered by submergible motor 126 to draw viscous production fluid from wellbore 116. This viscous fluid is discharged through fluid outlet 132 and into heating chamber 134. As pump 128 continues to fill heating chamber 134, the viscous fluid moves past submergible motor 126 and then submergible motor 122. The temperature of the fluid is raised by the heat dissipated at electric motors 126 and 122. This heat energy lowers the viscosity of the fluid and facilitates movement of the production fluid through pump intake 120 and submergible pump 118. The less viscous fluid is easily transported to another zone or to the earth's surface.

Optionally, an additional heater 138 may be mounted proximate heating chamber 134. For example, optional heater 138 may comprise a resistive element 140 mounted to an interior surface of outer housing 136, as illustrated in FIG. 7. Electric power may be supplied to resistive element 140 by an appropriate power cable, as described with reference to FIG. 1.

As will be appreciated by those skilled in the art, the particular configuration of power supply and control circuit 45 will vary depending on the size and configuration of the motor, e.g. motor 14. In general, however, where a submergible polyphase motor is used, circuit 45 will include multiphase disconnects and protection circuitry such as fuses, circuit breakers and the like. Circuit 45 may also include variable frequency drive circuits, such as voltage source inverter drives for regulating the rotational speed of motor 14 by modulation of the frequency of alternating current supplied to the motor in a manner known in the art. Drive circuitry of this type is available commercially from Reda of Bartlesville, Oklahoma under the commercial designation VSD. Moreover, while any suitable power conductor cable may be used, preferred cables include multistrand insulated and jacketed cables available from Reda under the commercial designation Redahot, Redablack and Readlead.

In an exemplary embodiment, a heating unit, such as fluid heater 40, may be electrically coupled to motor 14 and receives power through main power cable 36 as described in greater detail below. In general, once energized, the heating unit transmits thermal energy to the viscous wellbore fluids as described above. It should be noted that while the particular configuration of pumping system 10 is described herein for exemplary purposes, the foregoing components may be assembled with additional components, depending upon the configurations of the subterranean formations and the particular needs of the well. Similarly, the foregoing and additional components may be assembled in various orders to define a pumping system which is appropriate to the particular well conditions (e.g. formation locations, pressure, casing size and so forth).

Figure 8A:
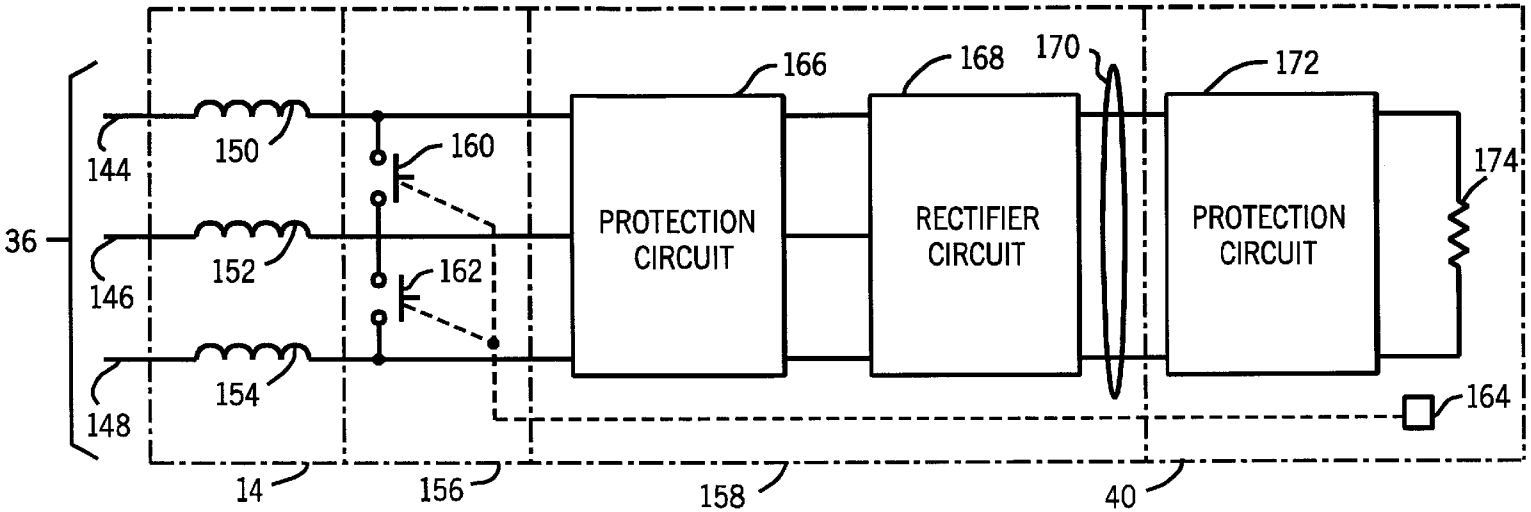
FIG. 8A is a schematic illustration of certain of the functional components of a pumping system similar to that illustrated in FIG. 1, but including a submergible heating unit coupled to common conductors leading through windings of a submergible electric motor.

FIG. 8A provides a diagrammatical view of certain functional components of system 10, including a portion of motor 14, a fluid heater, such as heater 40, and associated circuitry. Cable 36 includes a series of power conductors, including conductors 144, 146 and 148 for applying three-phase power to motor 14. Motor 14, in turn, includes a series of stator windings 150, 152 and 154 coupled to conductors 144, 146 and 148, respectively, for causing rotation of a rotor (not shown) within motor 14 in a manner well known in the art. As will be appreciated by those skilled in the art, stator windings 150, 152 and 154 will typically be wound and connected in groups depending upon the design of the motor stator, the number of poles in the motor, and the desired speed of the motor. A motor base 156 or other appropriate connector is provided for transmitting electrical power from motor 14 to the fluid heater through the intermediary of an appropriate heater interface 158. In this embodiment, motor 14 is connected internally to heater 40, and heater 40 is powered via power cable 36, in lieu of using a separate power cable 44.

In the embodiments illustrated in FIG. 8A, motor base 156 includes a pair of switches 160 and 162 connected across pairs of stator windings. Thus, switch 160 is configured to open and close a current carrying path between windings 150 and 152, while switch 160 is configured to open and close a current carrying path between windings 152 and 154. Switches 160 and 162 permit windings 150, 152 and 154 to be coupled in a wye configuration for driving motor 14, or uncoupled from one another when motor 14 is not driven. Switches 160 and 162 are preferably controlled by a temperature sensor 164, such as a thermistor. The preferred functionality of sensor 164 and switches 160 and 162 will be described in greater detail below.

Heater interface circuit 158 includes circuitry for limiting current through the fluid heater and for converting electrical energy to an appropriate form for energizing the heater 40. Accordingly, protection circuitry 166 will include overload devices, such as automatically resetting overcurrent or voltage relays of a type known in the art. Three-phase power from conductors 144, 146 and 148 are applied to protection circuit 166 through windings 152, 154 and 156 and, through protection circuit 166 to a rectifier circuit 168. Rectifier circuit 168, which preferably includes a three-phase full-wave rectifier, converts three-phase alternating current electrical energy to direct current energy which is output from circuit 168 via a direct current bus 170. Direct current bus 170 extends between heater interface circuit 158 and the fluid heater. Within the heater, direct current bus 170 applies a direct current power to an additional protection circuit 172, preferably including protection devices of a type generally known in the art.

The heater further includes a heater element 174 for converting electrical energy to thermal energy. While any suitable type of heater element 174 may be used in the heater, a presently preferred configuration, heater element 174 comprises a resistive heating element, such as a metallic coil. Alternatively, heater element 174 may comprise a metallic or ceramic block through which electrical energy is passed to raise the temperature of element 174. Thermal energy from element 174 is then transmitted to the fluids flowing along the heater.

In the embodiment illustrated in FIG. 8A, electric motor 14 may be energized to drive pump 12 by closing switches 160 and 162 in response to temperature signals received from sensor 164. The heater will be energized both when motor 14 is driven in rotation (i.e., when switches 160 and 162 are closed) as well as when motor 14 is held stationary (i.e., when switches 160 and 162 are open). This configuration is particularly suited to applications where viscous fluids require significant heating prior to driving pump 12 as well as during transfer of the fluids from the wellbore. Thus, sensor 164 will be configured to close switches 160 and 162 only when a predetermined temperature is sensed adjacent to the heater.

Figure 8B:
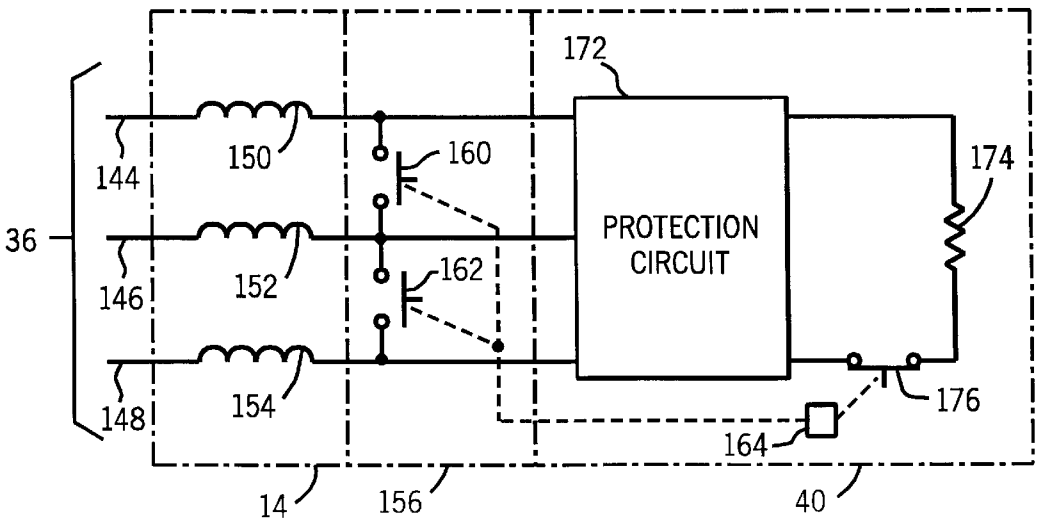
FIG. 8B is a schematic view of an alternative configuration of a heating unit for use in the pumping system illustrated in FIG. 1.

FIG. 8B illustrates an alternative configuration of motor 14, an appropriate connector link, such as motor base 156, and the heater. In the embodiment illustrated in FIG. 8B, the heater is configured to receive alternating current power directly from a protection circuit 172. Accordingly, alternating current power from conductors 144, 146 and 148 of cable 36 is applied to protection circuit 172 through the intermediary of stator windings 150, 152 and 154, respectively. Protection circuit 172, which preferably includes overcurrent protective devices, applies alternating current power directly to heater element 174. FIG. 8B also illustrates a feature of the heater by which a heater switch 176 is included in conductors supplying power to heater element 174. Switch 176 may be conveniently coupled to thermal sensor 164 and controlled in conjunction with switches 160 and 162 extending between stator windings 150 and 152, and between windings 152 and 154, respectively. In operation, sensor 164 is configured to open switches 160 and 162 and to close switch 176 to energize heating element 174 but to prevent rotation of motor 14 until a desired temperature is reached in viscous fluids surrounding the heater. When such temperature is reached, switches 160 and 162 are closed to begin pumping viscous fluids from the wellbore. Either simultaneously with closing of switches 160 and 162, or at a predetermined higher temperature, switch 176 is opened by sensor 164 to limit temperatures of adjacent viscous fluid to a desired maximum temperature. It should be noted that switches 160, 162 and 176 can be controlled in a variety of ways, including manual control from a surface location, to selectively provide power to motor 14 and/or heater 40.

Figure 8C:
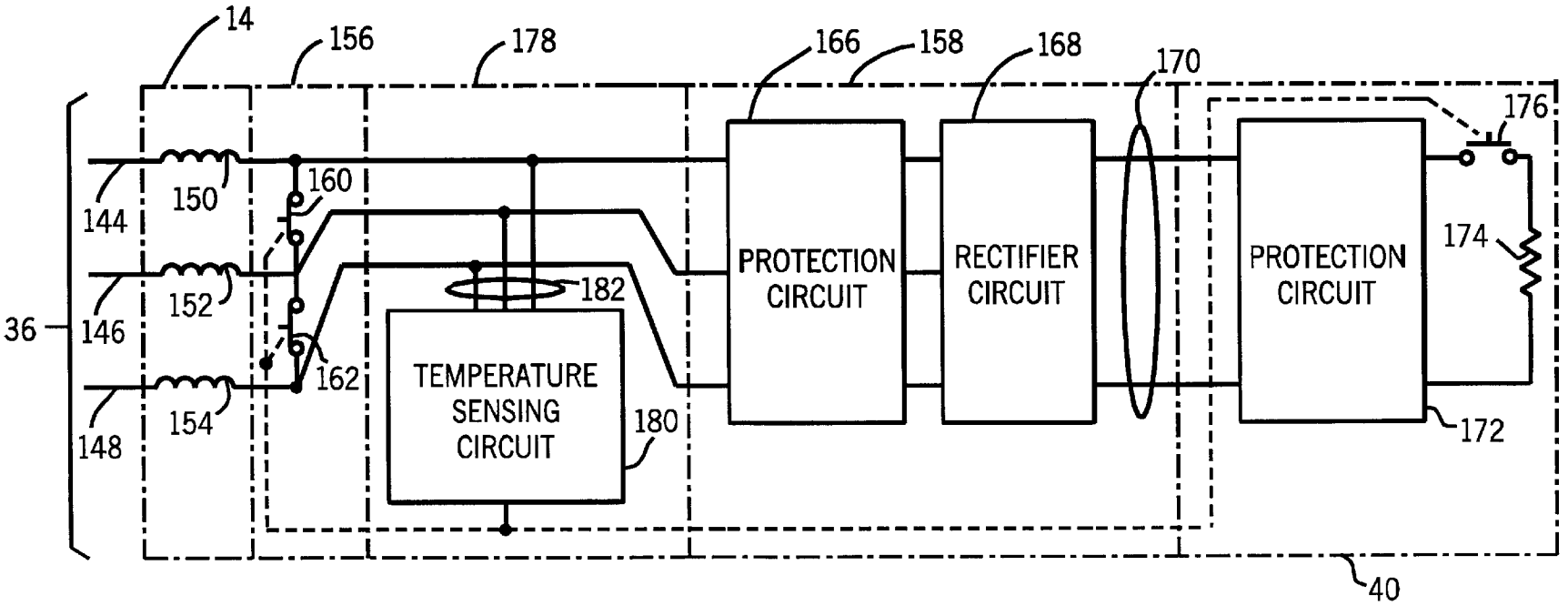
FIG. 8C is schematic illustration of a further alternative configuration of a heating unit, including a temperature sensing circuit configured for transmitting signals representative of temperature of viscous fluids in a wellbore to a position above the earth's surface.

FIG. 8C illustrates a further alternative embodiment of components of system 10, including motor 14, motor base 156, heater interface 158, heater 40 and a thermal sensing unit 178. In the embodiment illustrated in FIG. 8C, thermal sensing unit 178 includes a temperature sensing circuit 180. Circuit 180, which may include thermal couples or other temperature sensing devices, senses temperature adjacent to pumping system 10 and generates a signal representative of the temperature. Sensing units of this type are commercially available from Reda under the designation "PSI." Circuit 180 may also include memory circuitry for storing sensed temperatures, network circuitry for communicating the temperature signals to a remote location, and relay circuitry for commanding movement of switches 160, 162 and 176. Output conductors 182 transmit the temperature signals generated by circuit 180 to circuit 45 (see FIG. 1) and thereby to control or monitor circuit 45 above the earth's surface via conductors 144, 146 and 148. As will be appreciated by those skilled in the art, an alternative arrangement could include a separate conductor for transmitting the temperature signals to the remote location. Similarly, temperature sensing circuit 180 may include communication circuitry for transmitting temperature signals to a remote surface location via radio telemetry. An advantage of the embodiment illustrated in FIG. 8C is the provision of a single unit 178 for controlling energization of motor 14 and the heater, as well as for providing temperature signals which can be monitored by well operations personnel or equipment at the earth's surface.

It should be noted that the circuitry illustrated in FIGS. 8A through 8C offer distinct advantages. For example, rather than being supplied by separate power cables, the heater may be energized by electrical power supplied through the same cable used to drive motor 14. It has been found that the elimination of an additional power supply cable results in substantial cost reductions as well as in a reduction in the total weight of the equipment suspended in the wellbore. Moreover, the technique embodied in the foregoing arrangements permits the heaters to be conveniently coupled to the power cable through the intermediary of motor windings 150, 152 and 154. Thus, both motor 14 and the heater or heaters may be conveniently controlled by common thermal control circuits.

Figure 9:
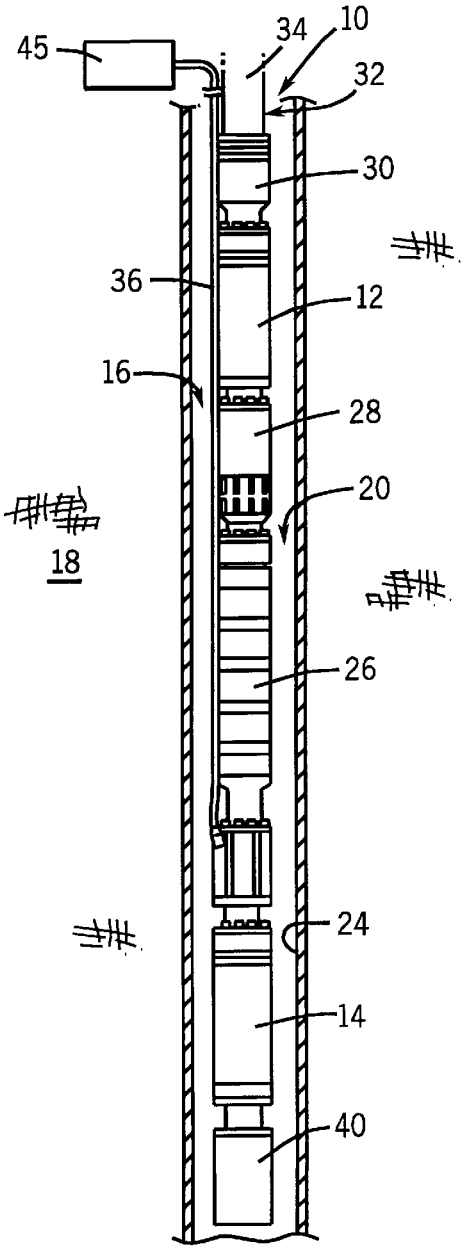
FIG. 9 is a front elevational view of a submergible pumping system positioned in a wellbore, according to an alternate embodiment of the present invention.

Referring generally to FIG. 9, an alternate embodiment is illustrated in which two heaters are coupled to motor 14. In this embodiment, heater 40 is disposed beneath motor 14 and powered via internal electrical connections. For example, heater 40 can be connected and powered as described with respect to the embodiments of FIGS. 8A through 8C.

A second heater 190 is coupled to motor 14 at an opposite end from heater 40. Heater 190 is an external heater that heats the wellbore fluids residing within wellbore 20. Preferably, heater 190 is internally, electrically coupled to motor 14. This allows power cable 36 to be plugged directly into heater 190 such that electrical power can be supplied to motor 14 and heater 40 without additional sections of external power cable.

Figure 9A:
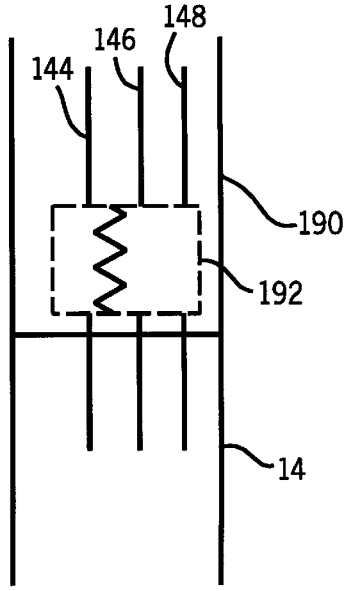
FIG. 9A is a schematic representation of a heater directly coupled to a submergible motor in series.
Figure 9B:
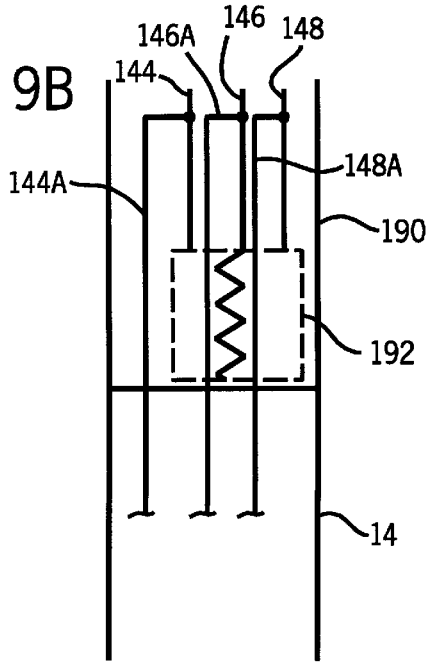
FIG. 9B is a schematic representation of a heater electrically coupled in parallel with a submergible motor.

By way of example, heater 190 can be coupled to motor 14 in a manner similar to the electrical coupling of tandem submergible motors, as is understood by those of ordinary skill in the art. Furthermore, motor 14 potentially can be electrically connected in series with heater 190 as illustrated in FIG. 9A or in parallel with heater 190 as illustrated in FIG. 9B. When connected in series, power from conductors 144, 146 and 148 flows in series through a heating element 192 of heater 190 and to motor 14 for application of three-phase power to motor 14. Alternatively, heater 190, and specifically heater element 192, may be connected in parallel, such that within heater 190 a plurality of motor conductors 144A, 146A and 148A branch off from conductors 144, 146 and 148 to apply three-phase power to motor 14. This parallel arrangement allows the use of a variety of switches to permit selective control of power to heater 190 and motor 14, as is generally described above with reference to motor 14 and heater 40.

It will be understood that the foregoing description is of preferred embodiments of this invention, and that the invention is not limited to the specific forms shown. For example, a variety of pumping system components may be incorporated into the illustrated pumping systems; a variety of heating elements can be used in constructing the various fluid heaters; various systems may be employed for deploying the pumping systems in wellbores; and the heated production fluid may be pumped to another zone or to the surface of the earth through production tubing, the annulus formed between the deployment system and the liner of the wellbore or through other methods of moving production fluid. These and other modifications may be made in the design and arrangement of the elements without departing from the scope of the invention as expressed in the appended claims.

What is claimed is:

1. An electric submergible pumping system for pumping fluids from a wellbore to a surface of the earth, comprising:

a submergible pumping system including:

a submergible pump;

a submergible motor having a drive shaft coupled to the submergible pump; and a heater disposed between the submergible motor and the submergible pump, the heater having an axial opening through which the drive shaft extends.

2. The electric submergible pumping system as recited in claim 1, further comprising a fluid intake through which a fluid is pulled from the wellbore into the pump, wherein the heater is disposed between the submergible pump and the pump intake.

3. The electric submergible pumping system as recited in claim 2, wherein the fluid is drawn through the axial opening to be heated.

4. The electric submergible pumping system as recited in claim 3, wherein the heater includes an electric heater element having a plurality of protrusions that extend into the axial opening.

5. The electric submergible pumping system as recited in claim 4, further comprising a second heater connected in the submergible pumping system, the second heater being disposed on an opposite side of the submergible motor from the heater.

6. The electric submergible pumping system as recited in claim 5, wherein the second heater includes an external heating element disposed to heat the fluid while it is external to the submergible pumping system.

7. The electric submergible pumping system as recited in claim 6, wherein the external heating element includes a plurality of external protrusions.

8. The electric submergible pumping system as recited in claim 4, wherein the plurality of protrusions include fins that extend generally radially inward from an outer heating core.

9. The electric submergible pumping system as recited in claim 8, wherein the fins are arranged in a staggered pattern to promote mixing of the fluid.

10. A system for pumping a viscous fluid from a wellbore, comprising:

a submergible pump;

a pump intake through which a fluid is drawn;

a submergible electric motor to power the submergible pump;

a motor protector; and a heater, wherein the submergible pump, the pump intake, the submergible electric motor, the motor protector and the heater are sequentially arranged for placement in a wellbore, and further wherein the heater is connected intermediate the submergible pump and the submergible electric motor.

11. The system as recited in claim 10, wherein the heater comprises an electric heater that is internally, electrically coupleable to the submergible electric motor.

12. The system as recited in claim 10, wherein the heater is connected intermediate the submergible pump and the pump intake.

13. The system as recited in claim 12, wherein the heater comprises an internal passage having a plurality of heating fins.

14. The system as recited in claim 13, further comprising a second heater having an external heating element.

15. The system as recited in claim 10, wherein the heater comprises an external heating element.

16. A system for pumping a viscous fluid disposed in a subterranean well, comprising:

a heating chamber;

a first pump disposed to pump a fluid into the heating chamber; and a second pump having a fluid intake disposed proximate the heating chamber, wherein the heating chamber the first pump and the second pump are connected in a pumping system that may be disposed in a wellbore.

17. The system as recited in claim 16, wherein the first pump is a positive displacement pump.

18. The system as recited in claim 17, wherein the heating chamber is heated by a submergible motor connected to the first pump to power the first pump.

19. The system as recited in claim 18, wherein the heating chamber is further heated by an electric heater.

20. An electric submergible pumping system for pumping fluids from a wellbore to a surface of the earth, comprising:

a submergible pump;

a pump intake;

a submergible motor;

a motor protector; and a heater, wherein the heater is internally, electrically coupled to the submergible motor, and further wherein the heater heats fluid flowing internally between the pump intake and the submergible.

21. The electric submergible pumping system as recited in claim 20, further comprising a switching circuit coupled to the submergible motor and the heater to permit the selective application of power to the submergible motor and the heater.

22. The electric submergible pumping system as recited in claim 20, further comprising a second heater.

23. The electric submergible pumping system as recited in claim 22, wherein the heater and the second heater are both mechanically coupled to the submergible motor.

* * * * *